United States Patent [19]

DeLuca et al.

[11] 4,307,638

[45] Dec. 29, 1981

[54] METHOD OF DISPERSING FLEXIBLE SHEET MATERIAL

[75] Inventors: Raymond F. DeLuca, Stamford, Conn.; Paul W. Jespersen, Houston, Tex.

[73] Assignee: Georgia-Pacific Corporation, Portland, Oreg.

[21] Appl. No.: 121,818

[22] Filed: Mar. 15, 1980

Related U.S. Application Data

[62] Division of Ser. No. 908,552, May 22, 1978, Pat. No. 4,206,858, which is a division of Ser. No. 792,308, Apr. 29, 1977, Pat. No. 4,137,805.

[51] Int. Cl.[3] ..... A47K 10/36

[52] U.S. Cl. ..... 83/37; 83/335; 83/345; 83/649; 226/91; 242/55.3

[58] Field of Search ..... 222/2, 96; 83/37, 334, 83/335, 345, 649, 650; 242/55.3, 55.53, 56.8, 58, 58.6; 226/91, 92

[56] References Cited

U.S. PATENT DOCUMENTS

| | | | |
|---|---|---|---|
| 3,572,600 | 3/1971 | Jespersen | 242/55.53 |
| 3,628,743 | 12/1971 | Bastian | 242/55.3 |
| 4,010,909 | 3/1977 | Bastian | 226/91 X |

*Primary Examiner*—James M. Meister

*Attorney, Agent, or Firm*—Schuyler, Banner, Birch, McKie & Beckett

[57] ABSTRACT

A dispenser for flexible sheet material having a reserve roll that automatically moves in the dispensing position when the dispensing roll is almost exhausted. The sides of reserve roll guide tracks are angled inwardly to engage the reserve roll spool at an off center point, so the spool is pushed downwardly into contact with a driving roller during rotation. The leading edge of the reserve roll towel engages the remaining portion of the almost exhausted dispensing roll and is moved therewith to be threaded through the dispensing mechanism. The perforating mechanism is assisted through the perforating stroke by a spring mechanism. The sensing roll is halted by a roll stop mechanism including a pivoted stop link and an anti-reverse pawl.

3 Claims, 9 Drawing Figures

180
98
108
82
34
24
181
182
90
84
20
102
184
86
112
105
232
185
238
92
134
230
236
236
244
127
125
240
122
146
110
120
154
148
128
126
158
138a
170
160
138c
172
234
158
138d
30
39
130
74
70
6
6
132
72

METHOD OF DISPERSING FLEXIBLE SHEET MATERIAL

This is a division of application Ser. No. 908,552, filed May 22, 1978 now U.S. Pat. No. 4,206,858, which in turn is a division of application Ser. No. 792,308, filed Apr. 29, 1977, now U.S. Pat. No. 4,137,805.

BACKGROUND OF THE INVENTION

1. Field

This invention relates to dispensers, and specifically to a dispenser for flexible sheet material such as paper toweling.

2. The Prior Art

Dispensers for flexible sheet material such as paper toweling have long been known which include mechanisms for moving a reverse roll into dispensing position and perforating or severing a roll into individual sheets. These dispensers generally include a perforating or severing mechanism comprising a number of rollers between which and around which the web material must pass, usually including a rotatably mounted knife and a rotatable roller having a cooperating slot for receiving the knife as it rotates past the roller. The sheet material passing therebetween is thus severed or perforated. Mechanisms must be included that measure the desired length of web, and then halt the mechanism.

The dispensers of this type known in the prior art recognize many problems and solve them in many different ways. The prior art dispensers are for the most part complicated in construction, making them expensive to manufacture and maintain, and prone to failure.

SUMMARY OF THE INVENTION

The dispenser of the present invention provides solutions to the problems present in the art, and does so by way of simple, reliable and relatively inexpensive mechanisms. The reserve roll advancing mechanism comprises two pairs of guides one fixed and one movable. When the roll of sheet material in the dispensing position is substantially exhausted, it drops out of the dispensing position by the action of gravity, and this allows the movable guides to pivot, causing the reserve roll held thereby to drop down into the dispensing position. The guides have inclined side surfaces that are biased inwardly against the sides of the roll spool at a point offset from the spool center. When the dispensing spool is related during dispensing of the sheet material, the interaction of spool ends against the guide sides urges the roll downwardly against a pinch roller, so that it remains in the lower most position as its diameter is reduced. When it is almost exhausted it is in position to drop out of the dispensing position.

The reserve roll is self-threading. The leading edge of the reserve roll is motivated into contact with trailing portion of the exhausted roll as it rotates by a series of strategically placed shoulders in the interior of the cabinet and once it contacts the other web of paper it is pulled thereby through the dispensing mechanism.

The dispenser also includes an overthrow spring mechanism for adding momentum to the action of the perforating knife and cooperating slotted roller as it moves through the perforating step. The length of each section is controlled by a roll stop mechanism utilizing a simple gravity operated rocking lever and an anti-reverse pawl, both operated upon by a series of rotating cams.

With the foregoing in mind, it is an object of the present invention to provide a dispenser for flexible sheet material having a mechanism for insuring the movement of a reserve roll into the dispensing position.

A further object of the invention is to provide a mechanism for automatically threading the leading edge of a reserve roll of flexible sheet material through the dispensing mechanism.

Another object of this invention is to provide a perforating mechanism that operates with a minimum of effort on the part of the user.

Still another object of this invention is to provide a very simple, effective and reliable roll stop mechanism.

Other objects and advantages of this invention will become apparent upon a consideration of the detailed description of a preferred embodiment thereof given in connection with the following drawings:

DESCRIPTION OF THE PREFERRED EMBODIMENT

The dispenser of this invention comprises a number of basic components and mechanisms, each of which will be explained in detail below. These are a chassis, a housing, means for supporting a web of sheet material in a dispensing position, a perforating mechanism, means for holding a reserve roll in a reserve position and then moving it into dispensing position, a mounting roll stop mechanism, and means for feeding the leading edge of the reserve roll through the dispensing mechanism.

THE CHASSIS AND THE HOUSING

Figure 1:
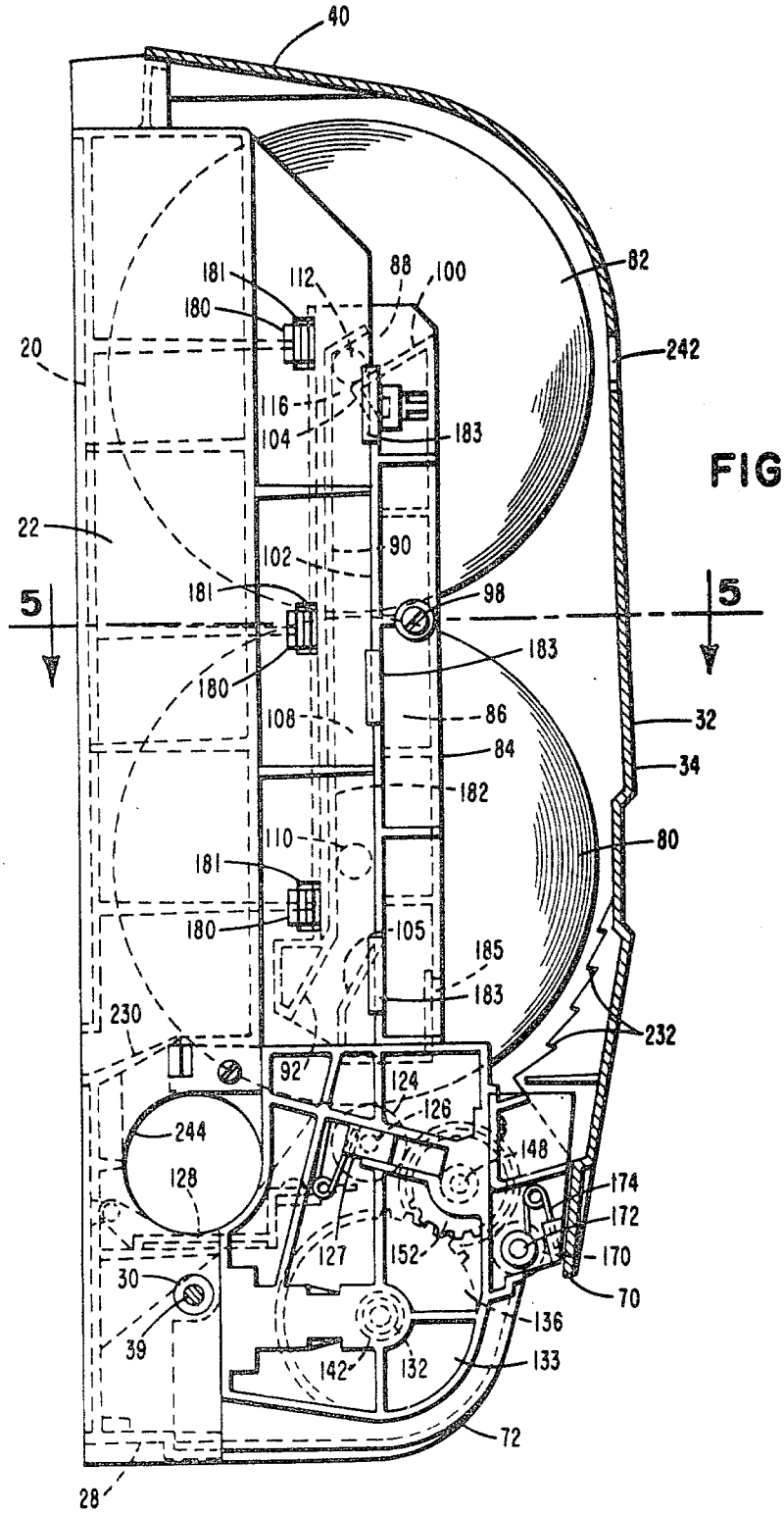
FIG. 1 is a left side view, partially in section, of the dispenser for flexible sheet material of this invention.
Figure 3:
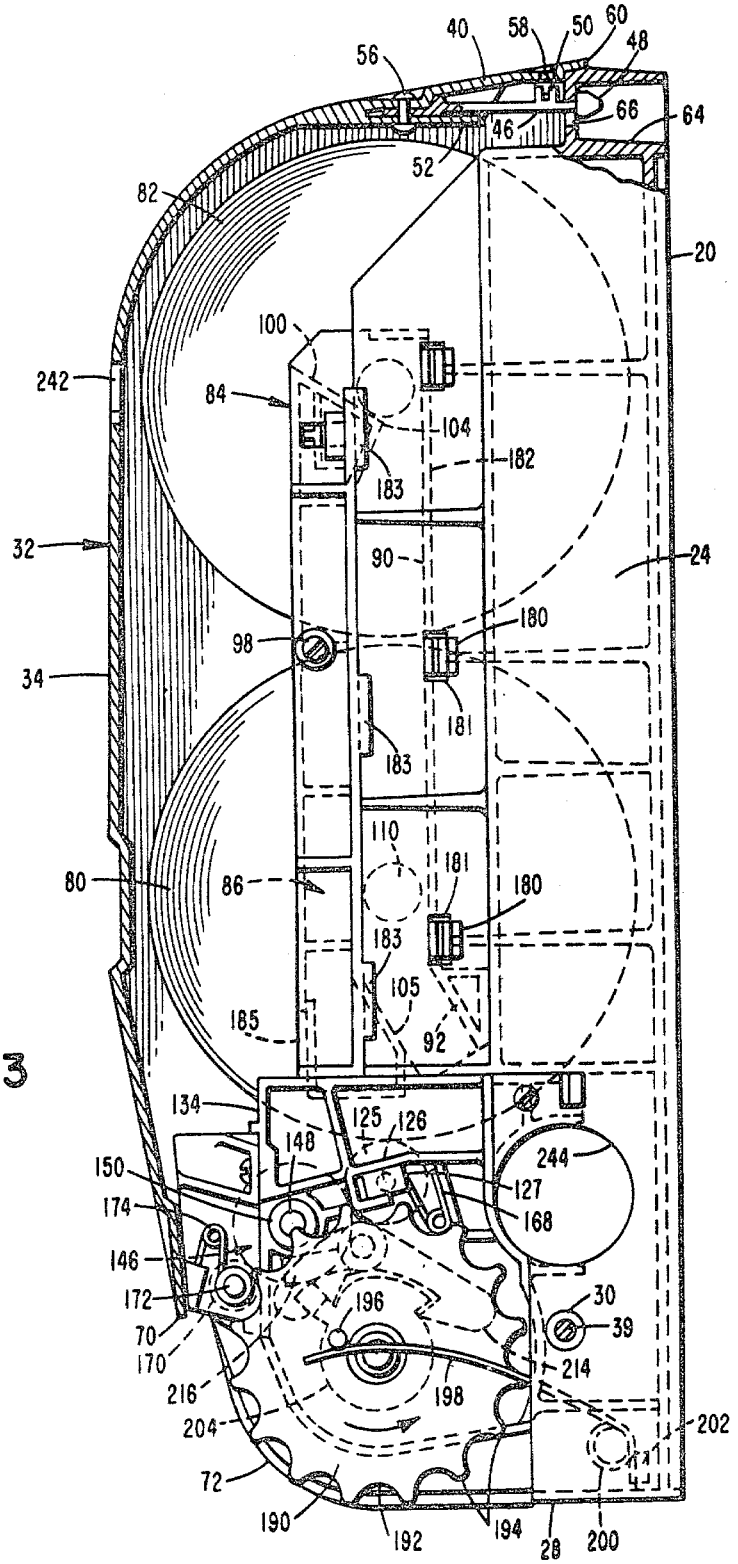
FIG. 3 is a right side view of the dispenser of FIG. 1, partially in section.

The chassis includes a back plate 20 which is adapted to be secured to a wall by suitable fasteners. Attached to back plate 20 is a right side plate 22 (FIG. 1) and a left side plate 24 (FIG. 3). Each of the side plates 22 and 24 are a composite construction, having inner and outer walls and strengthening ribs. A bottom plate 28 (FIG. 4) extends forwardly from back plate 20. Most of the mechanisms of the dispenser are supported by the chassis plates as explained below.

Formed on the outer side of each of side plates 22 and 24 in the lower portion thereof, is a housing pivot mount 30, by which the outer housing 32 is attached. The housing comprises a front panel 34, right panel 36, left panel 38, and top panel 40. A pair of matching pivot mounts 42 are on the inside of each of side panels 34 and 36, and coact with pivot mounts 30. Screws, not shown, through the center of pivot mounts 30 and 42, attach the housing to the chassis, allowing the housing to be opened downwardly to reveal the interior of the dispenser. Other types of pivot mounts can be used. The top panel 40 is provided on the inside with a cabinet latch mechanism, comprising a tongue 46 (FIG. 3) that has an enlarged portion 48 at its free end, and a key receiving recess 50 spaced inwardly from the end. Tongue 46 is received between the inner surface of top panel 40 and an interior flange 52, where it is secured by a rivet 56. A key opening 58 is provided in top panel 40, as is an edge portion 60. An upper channel-shaped chassis plate member 64 is provided with an opening 66 to receive enlarged portion 48. This latch is the subject of U.S. Pat. No. 3,971,237. Of course, other latch mechanisms can be used.

Figure 2:
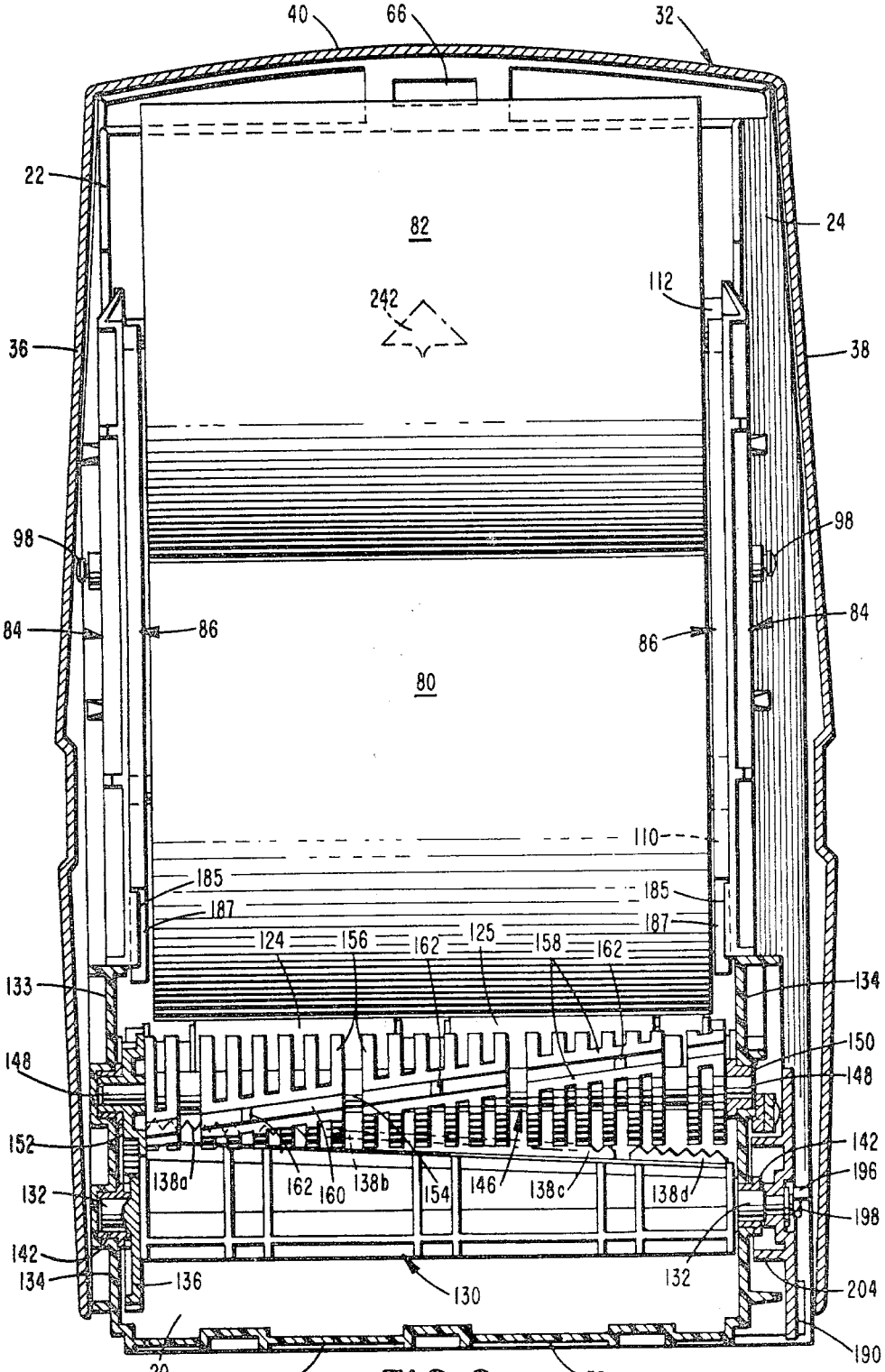
FIG. 2 is a front view of the dispenser of FIG. 1, partially in section.

Housing 32 terminates in an open end short of the bottom of the chassis, at an edge 70, below which the towel web extends from inside the dispenser. The chassis has a bottom shield 72 that curves upwardly from its attachment point to bottom plate 28, to close the bottom of the dispenser. The upper edge 74 of shield 72 is spaced slightly from lower edge 70, to form a slit through which the towel web is dispensed. Shield 72 is of offset sectional construction for strength (FIG. 2).

Extensions and attachments to the chassis are provided to support virtually all of the internal mechanisms of the dispenser. Such extensions and attachments will be described in conjunction with the description of the various mechanisms.

ROLL SUPPORTING MEANS

Figure 7:
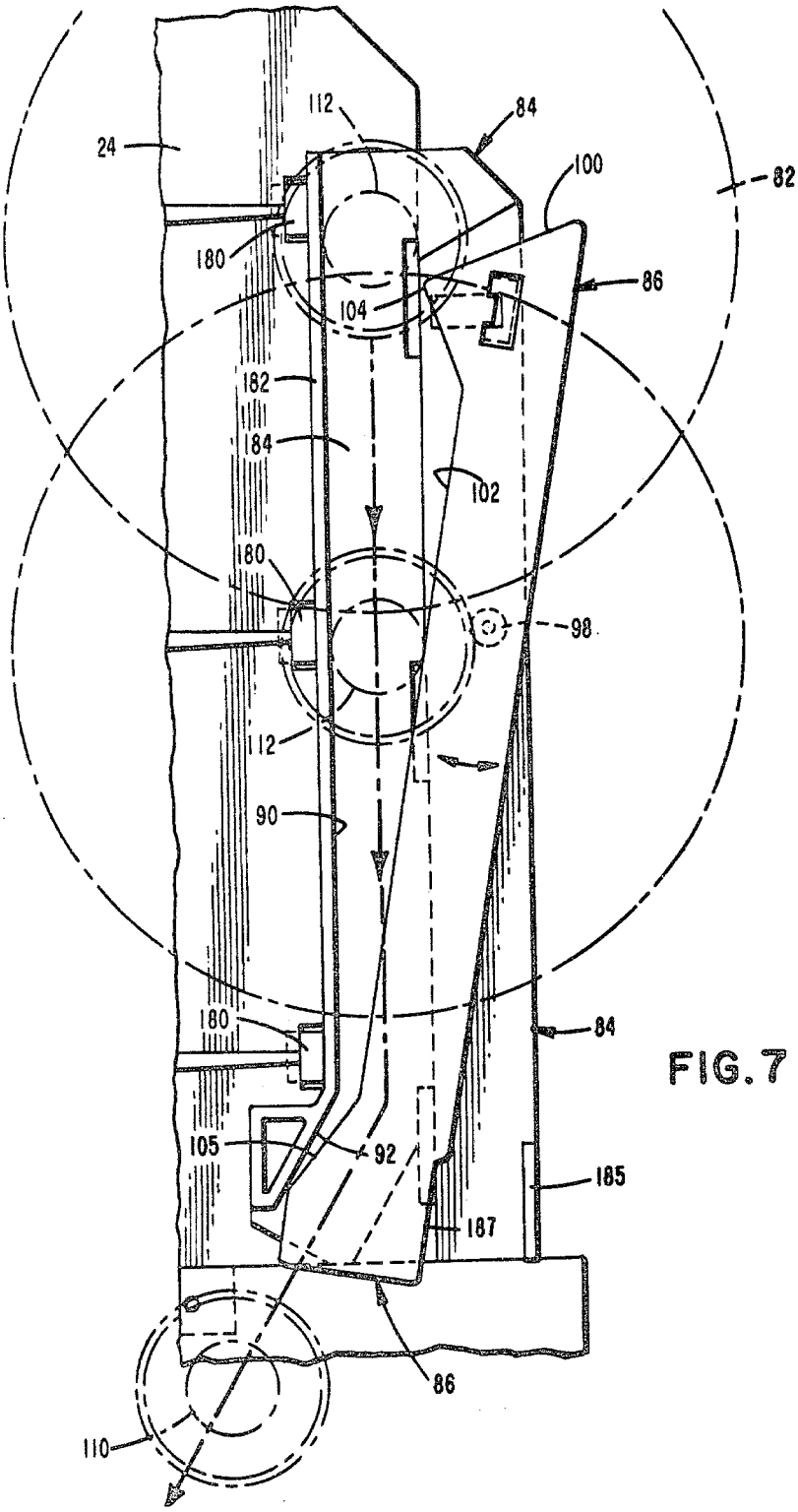
FIG. 7 is a left side view of the reserve roll release mechanism.

The roll supporting means holds two rolls of flexible sheet material 80 and 82. Roll 80 is in the dispensing position and roll 82 is in the reserve position. The roll supporting means comprises a pair of fixed guides 84 and a pair of movable guides 86, all of which are structural members built up from flat portions and ribbed portions, in a conventional manner. Fixed guides 84 are attached to chassis side plates 22 and 24 by screws. Each fixed guide 84 defines a fixed guide surface having an upper outwardly inclined upper portion 88, a main vertical portion 90 and a lower inwardly inclined portion 92. Each movable guide 86 is pivotally mounted to a side plate by a screw 98, and is freely pivotal. Each movable guide 86 comprises an upper outwardly inclined surface 100 and a main vertically oriented surface 102, which meet at a protusion 104. An inwardly inclined surface 105 is located at the lower end of each movable guide 86. The various surfaces of the fixed and movable guides define a passageway 108, through which the spindle of reserve roll 82 travels, as exlained below. Each roll of flexible web material 80 and 82 is mounted on a spindle 110 and 112, respectively. The diameter of spindles 110 and 112 is such that it cannot pass the narrowed portion 116 defined by protusion 104, and thus so long as movable guide 86 is in the normal position (FIGS. 1, 3 and phantom lines FIG. 7), reserve roll 82 is held in the reserve position. So long as dispensing spindle 110 is in channel 108, movable guide 86 remains in the normal position. When spindle 110 moves out of the channel, when the material on dispensing roll 80 is substantially exhausted, the weight of roll 82 acting on inclined surface 100 causes guide 86 to pivot to the release position shown in phantom lines in FIG. 4 and solid lines in FIG. 7, thus releasing roll 82 to drop to the dispensing position.

Figure 4:
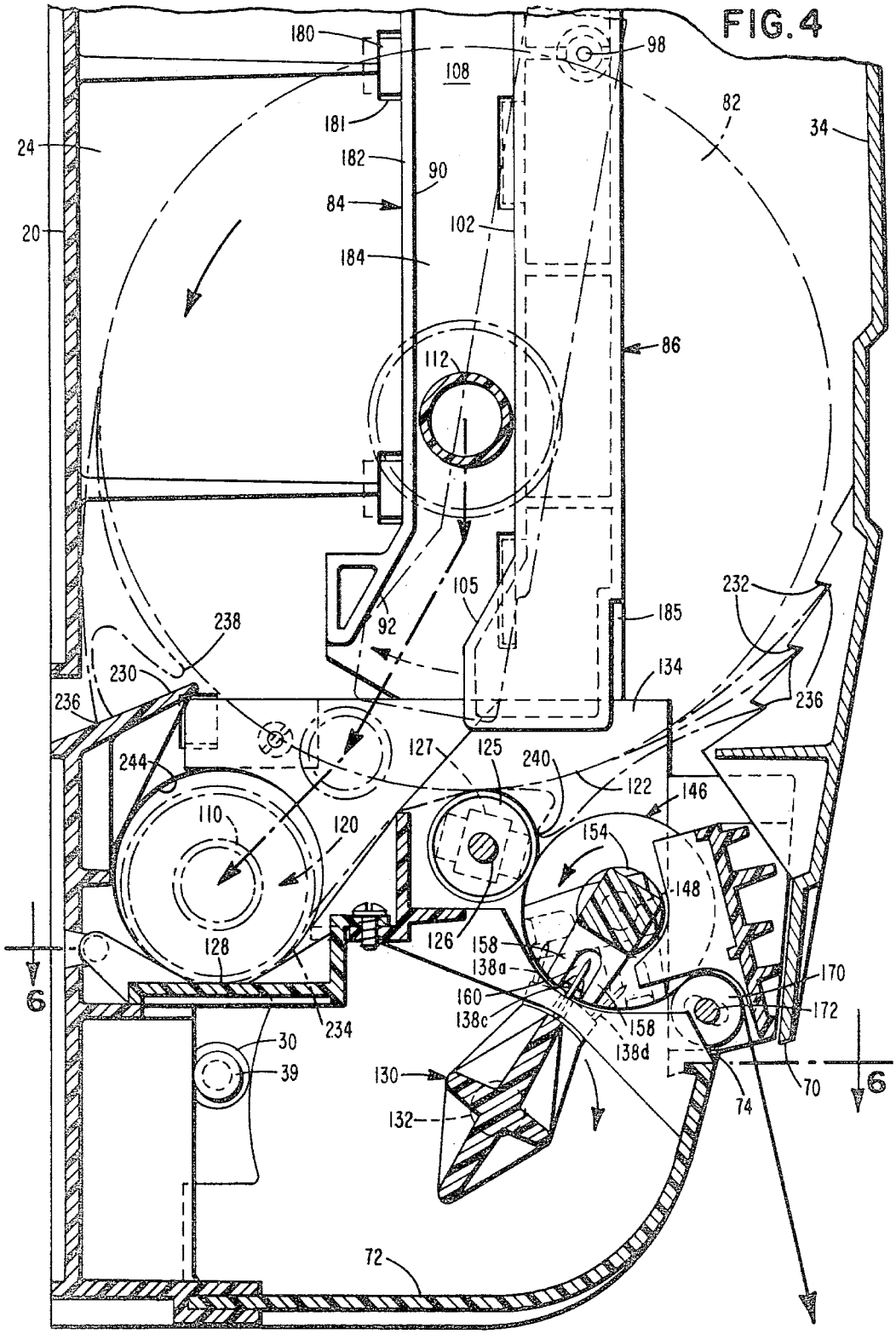
FIG. 4 is a left side view of the lower portion of the dispenser of FIG. 1, partially in section, showing the feeding and cutting mechanism.

Dispensing roll 80 is maintained in the dispensing position so long as its diameter exceeds a pedetermined size. This is best shown in FIG. 4 considering that for purposes of later describing the automatic threading of the end of a new roll, reserve roll 82 is illustrated in the dispensing position, and dispensing roll 80, now exhausted, has dropped into the expended position labeled as 120 in FIG. 4. The peripheral surface 122 rests upon a pair of pinch rollers 124 and 125 which are journaled for rotation on a shaft 126 in turn supported in blocks 127. When towel is pulled out of the dispenser by a user, the roll of flexible sheet material is rotated, and pinch rollers 124 and 125 cause the towel to bear firmly against another roller as explained later, to operate the perforating mechanism. For purposes of the movement of the dispensing roll and the automatic feeding of replacement roll, pinch rollers 124 and 125 serve as a stop against which periphery of the roll rests.

As roll 82 (FIG. 4) is consumed, its diameter decreases, and its center, as denoted by spool 112, moves downwardly in passageway 108. Finally, the diameter of roll 82 becomes so small that spool 112 moves beneath the lowermost point of fixed guides 84, and both spool 112 and roll 82 drop into the expended position labeled 120, then to reside in a compartment defined by a floor plate 128, which is attached to a back plate 20 and to side plates 22 and 24. The removal of spool 112 from between guides 84 and 86 permits movable guides 86 to pivot, if another reserve roll has been placed in the reserve position, and the new reserve roll moves downwardly until its peripheral surface stikes pinch rollers 124 and 125.

THE PERFORATING MECHANISM

The perforating mechanism is driven by pinch rollers 124 and 125. A cutter member 130 of generally elliptical cross-section is mounted on a rotatable shaft 132 which is supported at each end on a pair of lower side frame members 133 and 134. Cutter member 130 is provided at one end with a gear 136. It also has a toothed knife blade 138 mounted on its periphery and extending outwardly therefrom. As shown in FIG. 2, cutter member 130 is so configured as to support knife blade 138 in a helical spiral encompassing about 30 degrees of rotation of the cutter member. The blade is shown in an end view in FIG. 4. Blade 138 actually comprises several separate sections 138*a,b,c* and *d*, separated from one another, so that the towel is not cut completely through, the remaining small sections being torn through at a later point in the operating cycle. Advantageously, cutter member 130 is mounted for rotation on shaft ends 132 which are supported in journals 142 in the left and right lower side frame members 133 and 134.

Operating in conjunction with cutter member 130 is a slotted roller 146, that is rotatably mounted on a shaft having ends 148 received in journals 150, which are in turn supported by left and right lower frame members 133 and 134. A gear 152 is mounted on one shaft end 148, in constant mesh with gear 136 of the cutter member. Slotted roller 146 has a central portion 154 upon which are mounted a plurality of spaced disks 156. The disks support rails 158 that define slots 160 that extend at an angle to the axis of roller 146. A few ribs 162 breach the lots 160, and these are in alignment with the openings between blades 138*a,b,c* and *d*. The relationship between cutter member 130 and slotted roller 146 is such that as the two rotate together blade 138 enters slots 160 to make a cut across the width of the towel. Owing to the inclination blade 138 and the angle of slots 160, only a small portion of the towel is being perforated at any given moment. For each complete revolution of cutter member 130 and a slotted roller 146, the toweling is perforated across its entire width.

As will be explained in detail below, the toweling passes between pinch rollers 124 and 125 and the outer periphery of slotted roller 146. It is the function of pinch rollers 124 and 125 to insure that intimate contact is maintained between the toweling and the slotted roll 146 so that the action of the toweling being pulled out causes slotted roll 146 to rotate, and along with it cutter member 130. The journal blocks 127 that support rollers 124 and 125 are slidably mounted in slots 166 formed in left and right lower side plates 133 and 134, and are urged forward by springs 168, thus urging pinch rollers 124 and 125 toward slotted roller 146.

A second pinch roller 170 is located forwardly and downwardly of slotted roller 146, immediately inside of the opening in the cabinet through which the toweling is dispensed. Pinch roller 170 is mounted on a shaft 172 that is carried by a pair of springs 174, the springs urging the pinch roller toward slotted roller 146. This pinch roller causes the toweling to be urged around about half of the periphery of slotted roller 146, thus insuring that there is a minimum of slippage between the toweling and the slotted roller.

Figure 5:
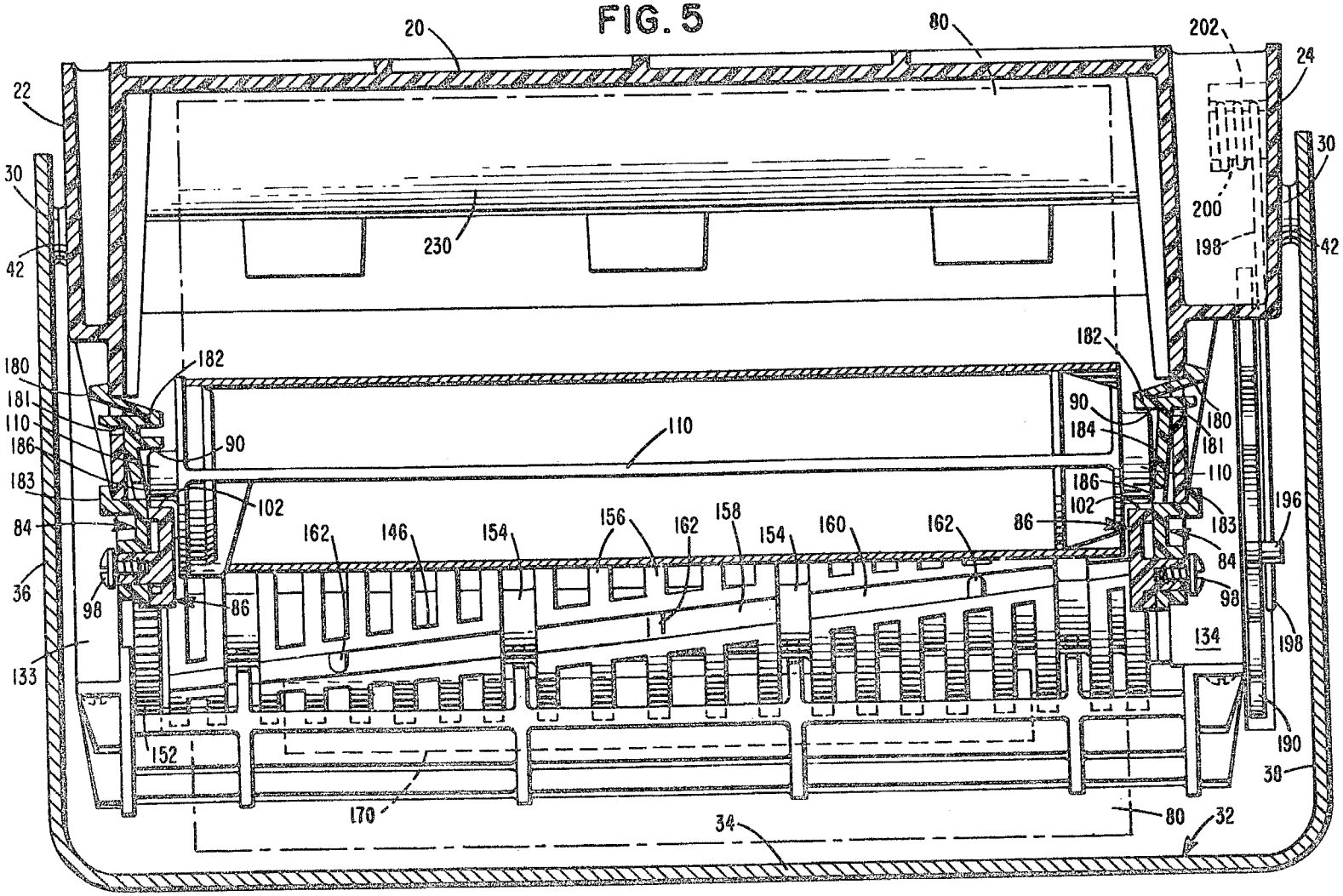
FIG. 5 is a view taken along line 5—5 of FIG. 1.
Figure 6:
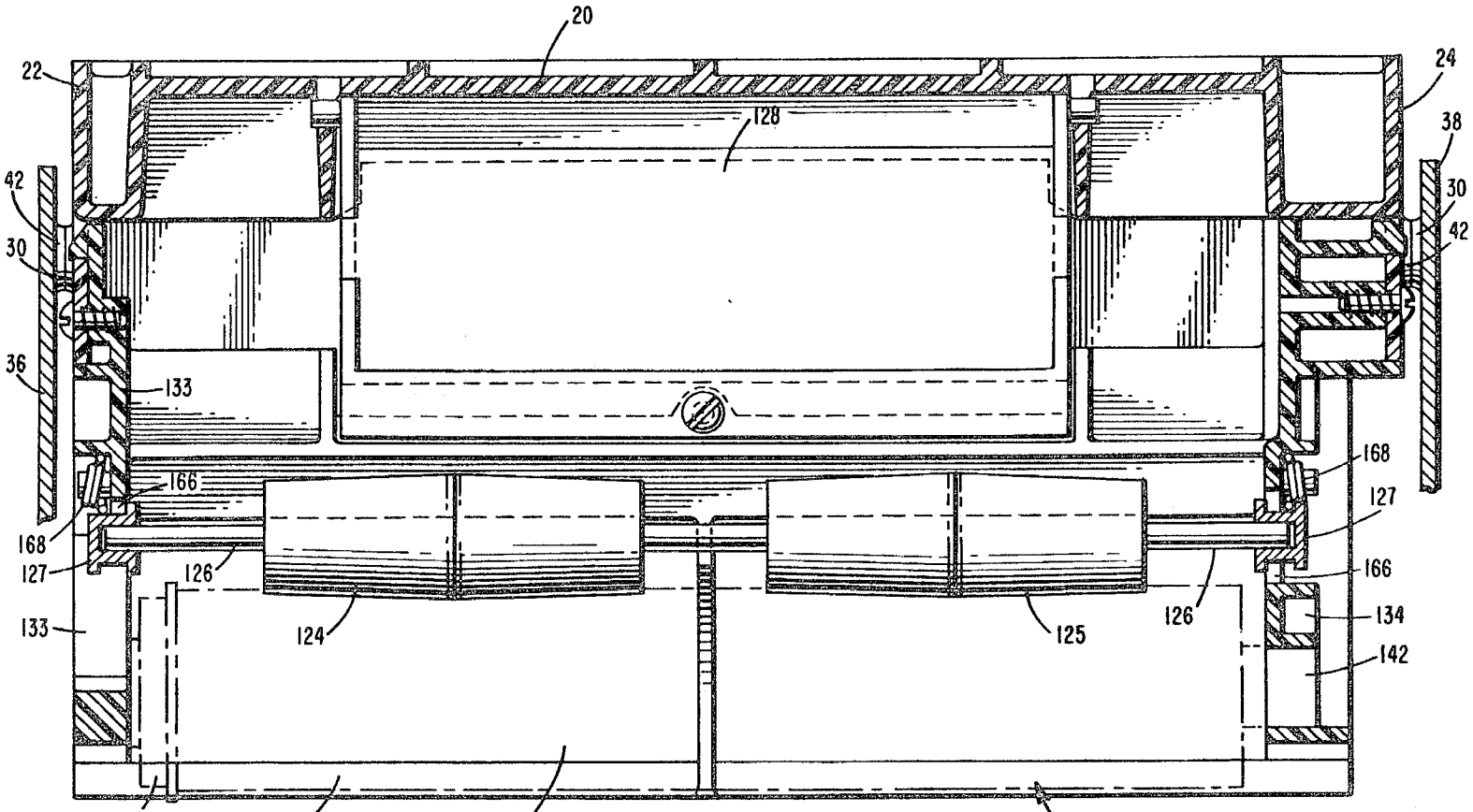
FIG. 6 is a view taken substantially along line 6—6 of FIG. 4.

In addition to the above described mechanisms for insuring good contact between the various rollers and the toweling, the guides in which the dispensing towel roll spool is mounted are provided with a novel means for insuring that the towel roll is constantly moved downwardly. This causes some driving pressure to be imparted to pinch rollers 124 and 125 by the outer surface of towel roll 80, as it rotates. It also insures that dispensing roll 80 does not hang up in the guides, but continuously moves downwardly. To this end, the fixed guides 84 each comprise a spring section 180 attached to the frame, a rear wall 182 and a side wall 184, which is angled inwardly in cross-section. Spring section 180 causes angled side wall 184 to be biased inwardly, against the flat end surface 186 of spool 110. As the dispensing roll is rotated to dispense towel, it is caused to rotate counterclockwise, as viewed in FIG. 1. Spool 110 then also rotates in the counterclockwise direction. Inclined side walls 184 contact the spool ends at a point spaced forwardly (as shown from the center of rotation (FIG. 5), so that the counterclockwise rotation causes spool 110 to tend to roll itself downwardly in the tracks. Of course gravity also acts, but this unique guide design insures positive downwardly movement.

MANUAL FEED, MEASURING AND ROLL STOP MECHANISM

This dispenser functions in such a manner that, at the end of each cycle, the leading end of the towel extends outwardly of the cabinet, in order to be grasped by the user. The device must have a means for measuring the length of each segment of toweling dispensed, and stopping the dispensing action at the end of the desired length. There also must be manual feeding mechanism to be used if necessary. The manual feeding mechanism and associated components are best shown in FIGS. 2, 3 and 9.

Figure 8:
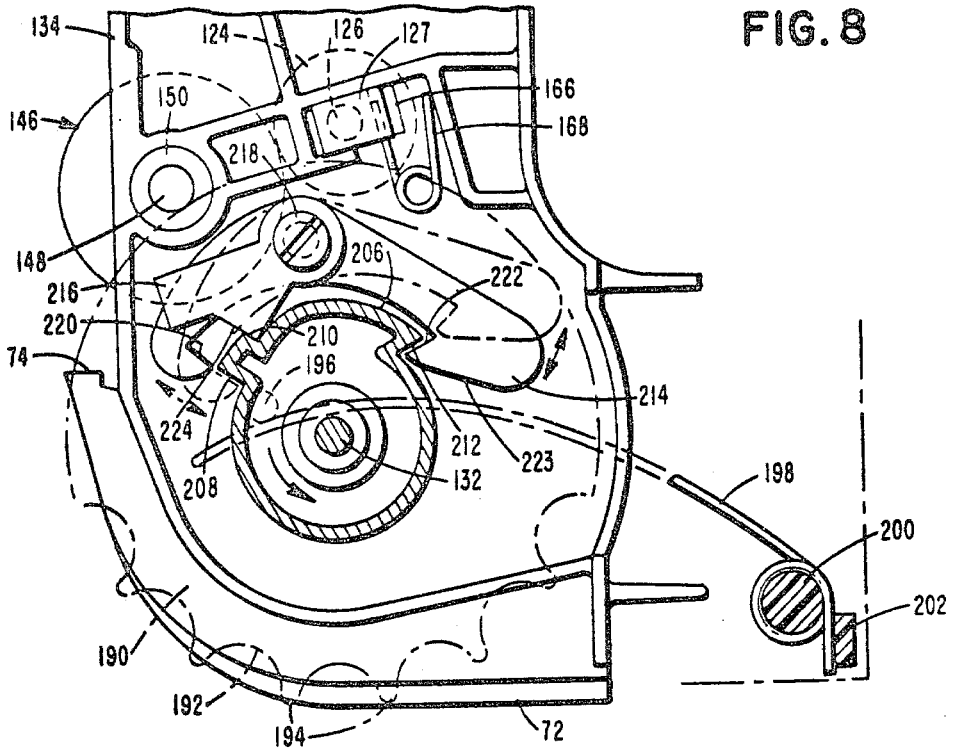
FIG. 8 is a detailed left side view of the momentary roll stop mechanism in the normal or released position.

This mechanism includes a manual feed wheel 190 mounted on the end of the cutter member shaft 132 and rotatable therewith. Around its periphery feed wheel 190 is provided alternating recesses 192 and projections 194 to facilitate rotation by the fingers of the user. Rotation of feed wheel 190 causes cutter member 130 and slotted roller 146 also to rotate, thus feeding towel. On the outer side of feed wheel 190 is a pin 196. A spring 198 is mounted on a peg 200 and engages a holding member 202 at one end. The other end of spring 198 engages the underside of pin 196. A cam 204 is integrally attached to the inside surface of feed wheel 190. Cam 204 (FIG. 9) has a camming surface 206, a cam stop face 208, an anti-reverse notch 210 and a cam release face 212. Cam 204 is of sufficient thickness to accomodate two cam followers, a stop-lever 214 and an anti-reverse pawl 216, both of which are pivotally mounted on a pin 218 and both of which are urged by gravity toward the positions shown in solid lines in FIG. 8. Stop-lever 214 has a lever stop face 220, a lever release face 222 and a lever camming surface 223. Anti-reverse pawl 216 an anti-reverse face 224.

The operation of this mechanism is as follows: When the leading end of the towel is pulled by the user, cutter member 130 and cam 204 rotate in the counterclockwise direction (FIG. 9), beginning from the position shown, but with stop lever 214 displaced from the position shown in solid lines, so that faces 208 and 220 are not in engagement. Anti-reverse pawl 216 is in its lower position, with anti-reverse face 224 in engagement with anti-reverse notch 210. Cam 204 rotates until the raised portion of the cam strikes lever camming surface 223, which pivots stop lever 214 into the position shown in solid lines in FIG. 9. Then, camming surface 223 rides on cam surface 206 until stop surfaces 208 and 220 engage, and the rotation of the towel dispensing and cutting mechanism is halted. During rotation, anti-reverse pawl 216 has also been riding on cam surface 206, and when surfaces 208 and 220 engage, pawl 216 drop downwardly by the action of gravity, to position surface 224 in notch 210. The distance between stop surface 208 and notch 210 is less than the distance between surface 220 and 224, so that some slight reverse movement of cam 204 is allowed.

Figure 9:
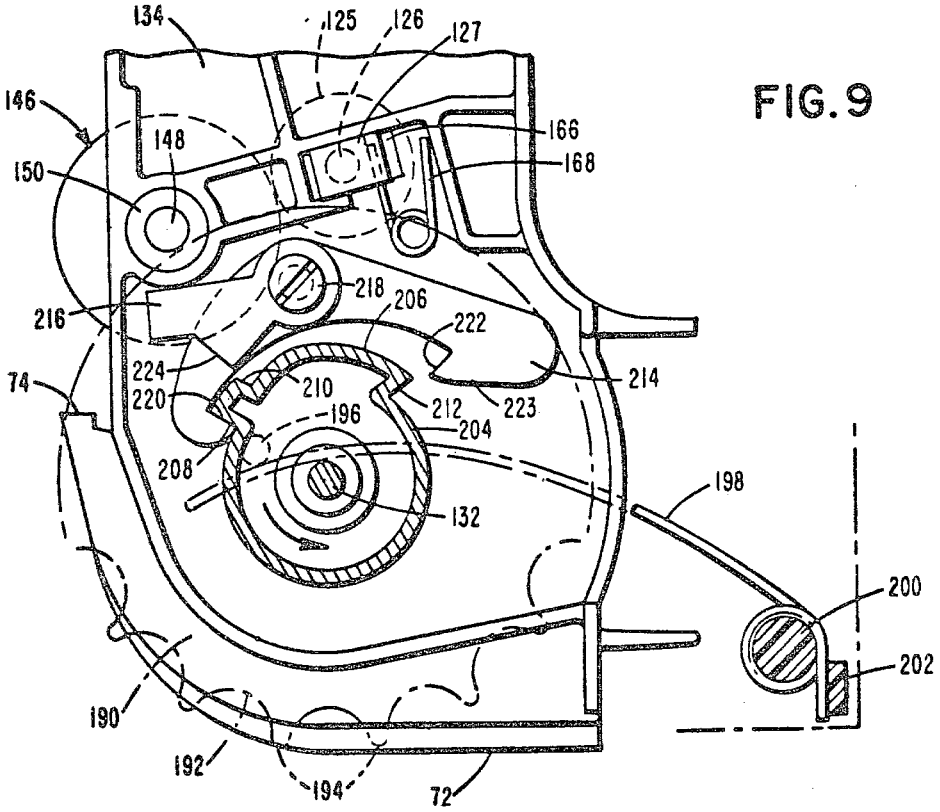
FIG. 9 is a detailed left side view of the momentary roll stop mechanism in the stop position.

As long as the towel is being pulled and pressure is placed on faces 20 and 220, stop lever 214 is maintained in the position shown in the solid line in FIG. 9. When pull on the towel is released, spring 198, bearing against peg 196, causes reverse rotation of cam 204, at which time notch 210 is engaged by anti-reverse face 224 to halt the reverse rotation after only a slight movement. When faces 208 and 220 disengage stop lever 214 is free to pivot clockwise to its initial position, with faces 212 and 222 in opposed relationship. The distance between face 220 and face 222 must be only slightly greater than that between faces 208 and 212, so that if cutter member 130 and cam 204 are rotate slowly, as by means of manual feed wheel 190, stop lever 214 does not have sufficient time to drop out of the stop position before faces 208 and 220 engage one another.

Another important benefit is obtained by the specific interrelationship of certain of the above described components. This is a force assist to the components that perforate the towel, so that the act of perforating is accomplishe without the need for the user to increase his pull upon the towel. During the first part of the rotation of cam 204, pin 196 pushes downwardly against the free end portion of spring 198. The design of spring 198 is such that the force component at the end portion is not great. After pin 196 passes the lowermost point of its rotative path, spring 193 begins to push upwardly, thus helping to rotate feed wheel 190, cutter member 130 and slotted roll 146. Spring 198 is so designed as to have a larger force component at the mid-point where it now engages pin 196. This added force gives the rotating parts extra inertia, and thus the perforating is assisted, the extra force necessary to drive the knife through the towel being provided not by the user but by the spring.

AUTOMATIC THREADING OF RESERVE TOWEL ROLL

The leading end of the reserve towel roll is automatically fed into the mechanism. At the time the dispensing roll is so depleted that it is released to fall into the expended position at 120, its toweling is still threaded through the feed and cutting mechanism, and continues to be unrolled and dispensed. The reserve roll has by now dropped into the dispensing roll position, as is roll 82 in FIG. 4. Somewhere around the outer periphery of roll 82 now lies the leading edge of the towel. This is not glued or otherwise held down, so it is free to move into the dispensing mechanism.

Extending inwardly from back plate 20 is a first ledge 230. Extending inwardly from the inside of outer housing 32 are a plurality of second ledges 232. At this point, the towel from roll 234 in the expended position extends (FIG. 4) over the top of pinch rollers 124, and 125 then between pinch rollers 124 and 125 and slotted roller 146, then between slotted roller 146 and pinch roller 170, and the outside of the dispenser. The location of the end of the full roll of toweling 82 is unknown. However, roll 82 rests upon pinch rollers 124 and 125 and will be rotated when pinch rollers 124 and 125 rotate. A user now pulls the towel to start a new cycle. As the dispensing, cutting and stop mechanisms operate, roll 82 is rotated. The objective now is to have the leading edge 236 of the new roll 82, or a folded portion of the towel of the new roll, be engaged by the dispensing mechanism, along with the towel of roll 234 which is being dispensed. This can happen in several ways. First, if leading edge 236 is located anywhere on the periphery of roll 82 between the 3 o'clock and the 8 o'clock position, rotation of roll 82 will cause leading edge 236 to strike ledge 230. Thereupon, a fold 238 will develop in the towel, which fold can be carried between ledge 230 and roll 82 to a point where it impacts the toweling from roll 234 somewhere in expended position 120 and is carried with it toward pinch rollers 124 and 125 and thereafter between pinch rollers 124 and 125 and slotted roller 146. Second, if leading edge 236 were intially located between the 6 o'clock position and the 8 o'clock position, it would impact directly upon the toweling from roll 234 in the area of position 120, and be carried along thereby. Third, if leading edge 236 were initially located between the 6 o'clock position and the 3 o'clock position, it would strike one of the second ledges 232, causing a fold 240 to be developed, which will move to a point between pinch rollers 124 and 125 and slotted roller 146 where it is grasped and moved between the pinch and slotted rollers, along with the other toweling being dispensed. Until roll 234 is completely exhausted, toweling from both rolls will be dispensed.

An inspection window 242 in housing 32 shows the custodian when the reserve roll has moved to the dispensing position. Opening housing 32 exposes an opening 244 in the frame through which the empty core can be removed from expended position 120.

Only a single preferred embodiment of the invention is described above. However, it should be realized that the scope of the invention is not limited by such description, but is governed only the scope of the appended claims.

We claim:

1. In a dispenser for flexible sheet material having an intial roll of sheet material; a reserve roll of sheet material, and apparatus to advance and perforate a web of said sheet material; a method for automatically feeding a web from the reserve roll through the dispenser, comprising the steps of:

(a) displacing said reserve roll to a dispensing position after said Initial roll has been exhausted a predetermined amount; and (b) buckling the leading edge of the web of said reverse roll whereby said web ultimately is enmeshed in said advancing and perforating apparatus and thence directing outwardly from said dispenser.

2. The method of claim 1, wherein the buckled leading edge of the web of said reserve roll is entrained with the as yet unexhausted trailing edge of said initial roll.

3. The method of claim 2, comprising the additional step of discharging said initial roll to an inoperative position prior to displacing said reserve roll to a dispensing position.

* * * * *